US009260892B2

(12) United States Patent
Lennhoff et al.

(10) Patent No.: US 9,260,892 B2
(45) Date of Patent: Feb. 16, 2016

(54) HANDLE HAVING A RETAINING ELEMENT, THE SAME HAVING AN ATTACHMENT MEANS WHICH REMAINS ENTIRELY INSIDE A MOVING PART

(75) Inventors: Ralf Lennhoff, Hagen (DE); Christof Brauner, Essen (DE); Dirk Müller, Essen (DE); Alexander Fromme, Velbert (DE)

(73) Assignee: HUF HULSBECK & FURST GMBH & CO. KG (DE)

( * ) Notice: Subject to any disclaimer, the term of this patent is extended or adjusted under 35 U.S.C. 154(b) by 567 days.

(21) Appl. No.: 13/455,729

(22) Filed: Apr. 25, 2012

(65) Prior Publication Data

US 2012/0274088 A1 Nov. 1, 2012

(30) Foreign Application Priority Data

Apr. 27, 2011 (DE) ..... 10 2011 002 287

(51) Int. Cl.

| | |
|---|---|
| ***E05B 3/00*** | (2006.01) |
| ***E05B 79/02*** | (2014.01) |
| ***E05B 79/06*** | (2014.01) |
| ***E05B 85/06*** | (2014.01) |
| ***E05B 77/44*** | (2014.01) |
| ***E05B 77/34*** | (2014.01) |

(Continued)

(52) U.S. Cl.

CPC ..... *E05B 79/02* (2013.01); *E05B 77/34* (2013.01); *E05B 77/44* (2013.01); *E05B 79/06* (2013.01); *E05B 85/06* (2013.01); *E05B 17/14* (2013.01); *E05B 81/90* (2013.01); *E05B 85/16* (2013.01); *Y10T 292/57* (2015.04)

(58) Field of Classification Search

CPC ..... E05B 77/34; E05B 77/44; E05B 79/02; E05B 79/06; E05B 85/06; E05B 81/90; E05B 85/16; E05B 17/14; Y10T 292/57

USPC ..... 292/336.3, DIG. 53, DIG. 54, DIG. 38; 70/423–428, 455

See application file for complete search history.

(56) References Cited

U.S. PATENT DOCUMENTS

| | | | |
|---|---|---|---|
| 2,102,714 | A | 12/1937 | Jakeway |
| 2,647,783 | A | 8/1953 | Jakeway |

(Continued)

FOREIGN PATENT DOCUMENTS

| | | | |
|---|---|---|---|
| CN | 2329729 | | 7/1999 |
| DE | 102008019013 | A1 | 10/2009 |

(Continued)

OTHER PUBLICATIONS

China Office Action for Chinese Patent Application No. 201210118718.1, OA Transmission Date Mar. 25, 2015, 10 pages, English Translation.

(Continued)

*Primary Examiner* — Kristina Fulton
*Assistant Examiner* — Christine M Mills
(74) *Attorney, Agent, or Firm* — Cantor Colburn LLP

(57) ABSTRACT

A handle for a moving part of a motor vehicle, particularly for a door, hatch, tailgate, or the like, having a retaining element which can at least partially be arranged on the outer paneling of the moving part, and having a support which can be arranged on the inside of the moving part and which is attached to the retaining element by means of an attachment means.

13 Claims, 2 Drawing Sheets

(51) Int. Cl.

| | |
|---|---|
| *E05B 81/90* | (2014.01) |
| *E05B 85/16* | (2014.01) |
| *E05B 17/14* | (2006.01) |

(56) References Cited

U.S. PATENT DOCUMENTS

| | | | | |
|---|---|---|---|---|
| 4,883,296 | A * | 11/1989 | Laurie | E05B 9/082 292/336.3 |
| 5,477,712 | A * | 12/1995 | Hill | 70/417 |
| 5,706,554 | A * | 1/1998 | Ruckert et al. | 292/336.3 |
| 7,302,819 | B2 * | 12/2007 | Lennhoff | 70/371 |
| 2010/0162777 | A1 * | 7/2010 | Savant | 70/101 |

FOREIGN PATENT DOCUMENTS

| | | |
|---|---|---|
| DE | 102008031218 | 1/2010 |
| EP | 0276972 | 8/1988 |
| EP | 1277900 | 1/2003 |
| EP | 2644808 A1 | 10/2013 |

OTHER PUBLICATIONS

China Office Action for Chinese Patent Application No. 201210118718.1, OA Transmission Date Mar. 25, 2015, 7 pages, non-English Translation.

* cited by examiner

HANDLE HAVING A RETAINING ELEMENT, THE SAME HAVING AN ATTACHMENT MEANS WHICH REMAINS ENTIRELY INSIDE A MOVING PART

TECHNICAL FIELD OF THE INVENTION

The invention relates to a handle for a moving part of a motor vehicle, particularly for a door, hatch, tailgate, or the like, having a retaining element which can be arranged at least partially on the outer paneling of the moving part, and having a support which can be arranged on the inside of the moving part and which is attached on the retaining element by means of an attachment means.

BRIEF DISCUSSION OF RELATED ART

A device for securing a lock cylinder is disclosed in DE 10 2008 019 013.6. The device is attached on a moving part of a motor vehicle. In this case, the invention includes a retaining element which runs on the outer paneling of the moving part and which is attached on a support on the inside of the moving part.

In this case, the retaining element has an opening, and at least the head region of the lock cylinder is accommodated in this opening. In addition, the retaining element has a flat structural shape running along the outer paneling of the moving part, wherein the retaining element is connected to the support via an attachment element which cannot be seen from the outside of the moving part. The attachment element runs at an angle with respect to the axis of rotation of the lock cylinder, wherein the end of the attachment element projects into the retaining element situated on the outside. Because the retaining element comprises an appropriate material thickness, it has been advantageously proven that this device provides good protection against break-ins.

BRIEF SUMMARY

The problem addressed by the present invention is that of creating a handle wherein it is possible to further increase the protection against break-ins while simultaneously keeping the complexity of installation low.

For this purpose, the invention suggests designing the retaining element in such a manner that the attachment means remains entirely inside the moving part, thereby making it possible to achieve increased protection against break-ins. An essential aspect of the invention is that the handle according to the invention offers virtually no points of attack where a potential tool can reach the attachment means, the same being entirely disposed inside the moving part, wherein the tool would be used to destroy the support, the attachment means, or other essential components attached to the support, for example. The support also is advantageously situated on the inside of the moving part, wherein the attachment means, the same establishing the connection between the support and the retaining element, constitutes the actual anchoring for the support. The attachment means can advantageously be designed as a screw element which provides a quickly established, reliable connection between the support and the retaining element inside the moving part. Because the attachment means is arranged entirely inside the moving part, manipulation thereof from the outside is made difficult. The configuration can particularly prevent manipulation, movement, or release of the handle on the moving part of the motor vehicle by means of releasing the attachment means in cases where this is undertaken for the purpose of entering the motor vehicle with malicious intent.

In one possible embodiment of the invention, the retaining element can have an opening, wherein a lock cylinder can be accommodated in the same. By way of example, an unlocking or locking process can be carried out manually for the moving part via the lock cylinder. The lock cylinder advantageously has an operative connection to a lock which functions to mechanically lock and/or unlock the moving part. The connection between the lock cylinder and the lock can be realized via a linkage, via a Bowden cable, or electronically, for example.

In order to further increase protection against break-ins, it can be advantageous that the retaining element has an angled first arm, wherein the attachment means engages with the same, and particularly the first arm has an attachment segment with which the attachment means engages. In addition, the attachment segment can have an opening through which the attachment means projects for the purpose of reliably connecting and anchoring the retaining element to the support. The angled first arm has the advantage of further impeding an attempt at manipulation in the region of the attachment means. In one possible embodiment of the invention, the attachment segment of the first arm is located below and separated from the remaining part of the retaining element situated on the outer paneling of the moving part, thereby constituting additional, effective protection for the attachment means.

A configuration wherein the attachment segment is oriented at an angle a to a part of the retaining element situated on the outer paneling can be particularly advantageous, wherein this angle a is within the range from approximately $0 \leq \alpha \leq 75°$. The attachment segment is advantageously oriented toward the lock cylinder or toward a dummy, wherein the dummy can be accommodated inside the opening of the retaining element, in contrast to the lock cylinder. It is particularly advantageous if the angle is between 20° and 50°, because it has surprisingly been shown that the ease of installation can be increased in this manner.

In a configuration that improves the invention, the retaining element can have at least one attachment element, wherein a protective cap which covers the opening and/or the lock cylinder is attached to said attachment element. The protective cap effectively prevents dirt particles, moisture, etc., from being able to penetrate inward from the outside, particularly into the lock cylinder. In a preferred embodiment of the invention, the protective cap is designed with a bowl shape, wherein when the same is attached to the retaining element, a hollow cavity is formed underneath the protective cap.

In one possible embodiment of the invention, the handle is an essential component of a system having a mobile ID transmitter for keyless activation of an access control system of a motor vehicle. In this case, the ID transmitter can communicate with a passive access control system, particularly an access and ignition control system of the motor vehicle. For example, the motor vehicle and the ID transmitter can exchange one or more codes with each other, and the communication carried out between the ID transmitter and the motor vehicle, and particularly the handle, can take place via a radio signal. The signals can particularly be transmitted inductively.

The signals can be advantageously encrypted for security reasons. The communication between the devices can be initiated manually by pressing a button on the ID transmitter, or via the proximity thereof to the handle, and/or contact with the handle, or alternatively without any active actuation, wherein the communication is initiated and controlled passively. In order that the motor vehicle can also be used when the electronics either inside the ID transmitter or based in the motor vehicle fail, the protective cap can be advantageously attached to the retaining element in a removable manner. For such a situation, a mechanical emergency key can be inserted into the lock cylinder after the protective cap is removed from the retaining element, to thereby unlock and/or lock the locking device of the moving part. The emergency key is advantageously arranged or attached on the ID transmitter.

The protective cap can advantageously comprise a locking connection to the retaining element. In one elegant and compact solution, the configuration can include a locking connection for the protective cap which is disposed on the inside thereof, such that this locking connection is concealed from the outside of the motor vehicle. An embodiment of the handle can be contemplated wherein the protective cap has at least one window, wherein an auxiliary device can be inserted manually through said window in order to release the locking connection. In this case, the auxiliary device can be an emergency key, for example, which is incorporated into an ID transmitter. The protective cap advantageously has locking elements which possess an elastic property, such that the auxiliary device, after the same is guided through the window and has been inserted sufficiently far into the hollow cavity of the protective cap, acts on the locking element in such a manner that the latter is moved out of its locking position. Subsequently, the user can easily remove the protective cap from the retaining elements.

In order to further increase the protection offered against break-ins, the lock cylinder and/or the dummy in the region of the opening of the retaining element is positioned flush with the retaining element. In addition, a configuration can also be contemplated wherein the head region of the lock cylinder additionally comprises a reinforced material. For example, the head region can be composed of a metal possessing increased durability. A configuration can also be contemplated wherein the head region is a component made of a zinc pressure die cast alloy (such as zamak). As an alternative, the head region can be constructed from a hardened steel or from a reinforced plastic. With this measure, the configuration can increase the protection against break-ins.

The retaining element can advantageously be constructed from a metallic material, particularly from steel, wherein the thickness S of the retaining element is particularly in the range between 0.5 mm≤S≤3 mm The retaining element is preferably a body having increased mechanical durability. The retaining element can alternatively be a body made of a reinforced plastic. The retaining element is advantageously constructed from a hardened steel, stainless steel, or a zinc pressure die cast alloy (such as zamak, for example). In addition, a configuration can be contemplated wherein the support is pre-assembled with the lock cylinder, together forming one structural unit which is attached on the interior of the moving part.

It has been shown to be advantageous if the retaining element has a second arm which abuts the support on the interior of the moving part, and/or is supported on this support, and particularly if the second arm has shoulder elements which contact the support. Like the first aim, this second arm is designed as a continuation of the retaining element, and extends into the interior of the moving part, and can be fixed on the support via a suitable shape and/or force-fit connection.

According to the present invention, it can be advantageous if the support is attached on the first arm of the retaining element via the attachment means, and to achieve this attachment, the support is pressed or clamped toward the inner side of the moving part during the attachment process and/or the second arm of the retaining element simultaneously assumes a position on the support such that the second arm firmly contacts the support. As such, it can be contemplated that the support is attached on the first arm via the attachment means. At the same time, the support is connected to the second arm via a positive-fit or force-fit connection, wherein this connection can be a clamp connection, for example.

In one configuration that improves the invention, the lock cylinder is designed with a housing, wherein the housing is designed in such a manner that the housing is attached to the first arm by means of the attachment means. In this way, the housing serves as additional protection for the lock cylinder situated on the inside, and the lock cylinder can be accommodated inside the housing such that it can rotate. The housing can have an extension which runs toward the first arm and can be attached at that location on the attachment means in a reliable manner. The design, according to the invention, of the housing has the effect that few components are required to ensure a reliable attachment of the lock cylinder and of the lock cylinder housing. The attachment region of the second arm is simultaneously exploited for the attachment of the lock cylinder and the lock cylinder housing.

In addition, it is possible for the housing to have a molded collar which protects the attachment means. This collar is preferably advantageously molded on the extension of the lock cylinder housing, such that the configuration creates additional protection for the attachment means, the same being disposed behind the collar.

In order that the protective cap is held reliably on the retaining element, the retaining element can have at least one bearing surface where the protective cap abuts the retaining element. In addition, the retaining element and/or the protective cap can have a seal in order to prevent damaging particles, moisture, etc., from penetrating into the interior of the moving part.

It can be advantageous for the protective cap to be a 2-piece component, wherein the first element of the protective cap is an outer body, and the second element is the locking element. The properties of the materials can be advantageously different between the first and the second elements, for example with respect to the elasticity thereof.

BRIEF DESCRIPTION OF THE DRAWINGS

Additional advantages, features, and particularities of the invention are found in the following description, wherein multiple embodiments of the invention are described in detail with reference to the illustrations.

DETAILED DESCRIPTION

Figure 1:
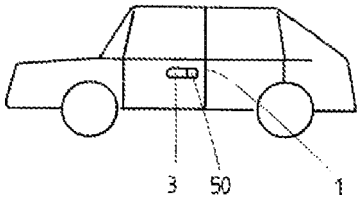
FIG. 1 shows a purely schematic illustration of a motor vehicle, with a handle according to the invention for a motor vehicle door illustrated on the vehicle.
Figure 2:
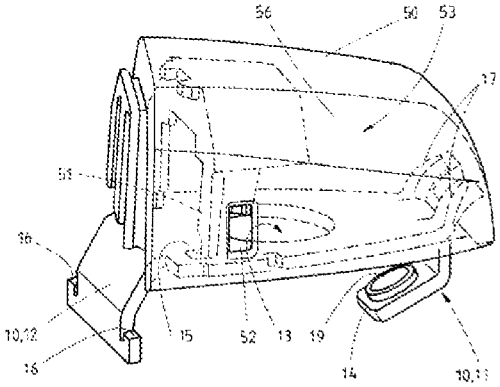
FIG. 2 shows an essential component of the handle shown in FIG. 1, having a protective cap which is attached to a retaining element.
Figure 3:
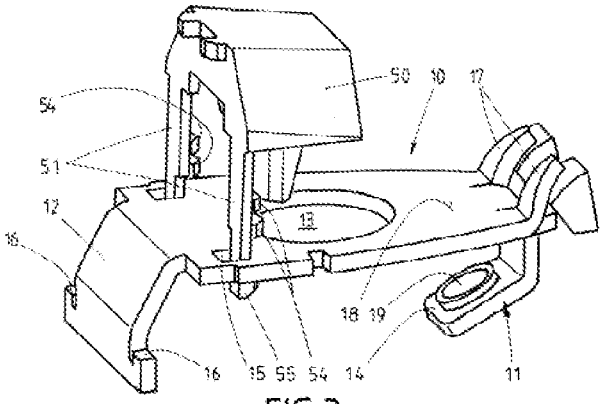
FIG. 3 shows a detailed view of FIG. 2.
Figure 4:
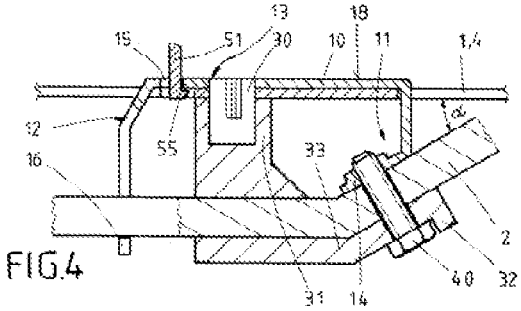
FIG. 4 shows a further embodiment in a cutaway view.

FIG. 1 shows a schematic illustration of a motor vehicle, having a handle on the door 1 thereof, wherein the handle has a handgrip 3 on the outer side thereof. A protective cap 50 is arranged on the side of the handgrip 3. A lock cylinder, by way of example, can be concealed being the protective cap 50, wherein a key can be manually inserted into the lock cylinder in order to unlock and/or to lock a lock of the door 1. This lock is not explicitly illustrated. As shown in FIGS. 2 through 4, the region of the handle on which the protective cap 50 is positioned is shown. The protective cap 50 is attached to a retaining element 10 and can be removed from the same. The retaining element 10 has different regions, such that this retaining element 10 functions inside the handle as a multi-function component. The retaining element 10 runs at least partially on the outer paneling, particularly on the door panel 4 of the door 1. In addition, the retaining element 10 is designed with an opening 13 which accommodates a lock cylinder 30 (see FIG. 4), which is shown in a purely schematic manner. In this case, the lock cylinder is flush with the surface 18 of the retaining element 10.

In addition, the retaining element 10 has an angled arm 11 which extends through an opening of the outer paneling 4 of the door 1, and therefore ends on the inside of the door 1. The arm 11 is angled and comprises an attachment segment 14 which is oriented at an angle a relative to the outer paneling 4 in the present embodiment, wherein the angle a is approximately in the range from 20° to 30°. The attachment segment 14 also has an opening 19 through which an attachment means 40 extends. The attachment means 40 is a screw element in the present embodiment. This screw element 40 connects the retaining element 10 to a support 2 of the handle, wherein this support runs along the inner side of the door 1. The support 2 of the handle has different functions, wherein the support 2 can particularly have a bearing surface for the moving grip 3, which is not shown in detail. In general, the support 2 runs along the inside of the door 1 in the longitudinal dimension of the vehicle, and has additional functions according to the type of handle as described above. These functions are not addressed in detail below. As can be seen in FIG. 2 to FIG. 4, the support 2 can be fastened via the attachment means 40 at the retaining element 10, thus allowing ultimately that the support 2 can be reliably fixated at the inside of the door 1. As can be clearly seen in FIG. 2 to FIG. 4, the attachment means 40 is situated entirely inside the door 1. In addition, the retaining element 10 has a second arm 12 which extends into the inner region of the door 1 like the first arm 11. The second arm 12 is constructed with two shoulder elements 16, and the support 2 is supported on these shoulder elements [16]. During installation of the handle, the screw element 40 is accordingly tightened on the first arm 11 of the retaining element 10, and at the same time the second arm 12 contacts the support 2 until a reliable clamping is achieved on the shoulder element 16. As such, the retaining element 10 is reliably attached on the door 1, and at the same time, the support 2 on the inside is fixed inside the door 1.

As FIGS. 2 through 4 clarify, the retaining element 10 has two attachment elements 15 in the form of openings 15 into which the locking elements 51 of the protective cap 50 project. According to the illustrated embodiment, the protective cap 50 is particularly connected to the retaining element 10 via a locking connection. In addition, the protective cap 50 has a window 52, which is arranged on the side of the protective cap 50. The locking elements 51 are situated inside the protective cap 50, and particularly in a hollow cavity 53 which is formed by the protective cap 50. The locking elements 51 have projections 54 which can be actuated by means of an auxiliary device, for example an emergency key, in order to release the locking elements 51 from their locking position indicated in FIGS. 2 through 4. According to the illustrated embodiment, the projections 54 are beveled, such that the configuration facilitates an elastic deformation of the locking elements 51 by means of the auxiliary device, wherein the same can be guided into the hollow cavity 53. The positioning of the locking elements 51 inside the hollow cavity 53, as well as the positioning of the window 52 on the protective cap 50 is such that the projections 54 of both locking elements 51 are actuated when an auxiliary means is inserted through the window 52 into the hollow cavity 53, and therefore both locking elements 51 are moved out of their locking position. Subsequently, the protective cap 50 can be moved out of its position as shown in FIGS. 2 through 4, and removed from the retaining element 10. The locking elements 51 have a nose-like projection 55 on their free ends, and this projection [55] serves to ensure the locking connection of the protective cap 50 on the retaining element 10.

The retaining element 10 comprises a metal material, in this case of steel. As an alternative to the lock cylinder 30, a dummy can be inserted into the opening 13. This is reasonable in the case of a handle, by way of example, which is used on the passenger side door. As FIG. 4 in particular clarifies, the lock cylinder 30 has a housing 31, and the housing 31 has an extension 33 which extends toward the first arm 11. The housing 31 is particularly likewise attached to the first arm 11 via the attachment means 40, as is the support 2. In addition, the illustrated embodiment shows that the housing 31 has a collar 32 which is disposed in front of, and protects, the attachment means 40.

The embodiment shown in FIG. 1 to FIG. 4 shows a handle which is characterized by increased protection against break-ins. This protection is due, among other things, to the fact that the attachment means 40 is situated entirely inside the door 1. In addition, the angled first arm 11 contributes to the arrangement wherein it is more difficult to destroy the attachment means 40 during a break-in attempt from the outside. The collar 32 additionally protects the attachment means 40 from manipulation from the outside.

Figure 5:
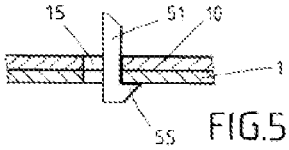
FIG. 5 shows a detailed view of a further embodiment in FIG. 4.

FIG. 4 shows that the locking element 51 acts via its projection 55 on the retaining element 10, and particularly on the opening 15 of the retaining element 10. As an alternative, a configuration can likewise be contemplated wherein the locking element 51 according to FIG. 5 extends through the opening 15 of the retaining element 10, and engages via its projection 55 with the door 1, 4, thereby constituting a reliable locking connection.

The protective cap 50 can be a 2-piece component, wherein an outer body 56 is designed as a first element of the protective cap 50, and the locking element 51 is included as the second element of the protective cap 50. This is indicated schematically in FIG. 2 and FIG. 3. The second element of the protective cap 50 is shown in its entirety in FIG. 3, wherein in FIG. 2 the outer body 56 is shown, and the second element, situated on the inside, is indicated by a dashed drawing.

The invention claimed is:

1. A handle for a moving part of a motor vehicle, comprising:

a retaining element having a planar surface with a first side and a second side, and which can at least partially be arranged on the an outer paneling of the moving part, whereat the outer paneling has an outer surface and an inner surface, and a unitary support which can be arranged on the an inside of the moving part, and which can be attached by means of an attachment means on the retaining element, wherein the retaining element is designed in such a manner that the attachment means remains entirely inside the moving part and the second side of the planar surface is in direct contact with the outer surface of the outer paneling when the retaining element is in an assembled state, thereby making it possible to achieve increased protection against break-ins wherein the retaining element has an angled first arm, and the attachment means engages with the first arm, wherein the first arm particularly has an attachment segment and the attachment means acts on the attachment segment, wherein the retaining element has a second arm, which abuts the support and/or is supported on the support on the inside of the moving part, and the second arm has shoulder elements which contact the support.

2. A handle according to claim 1, wherein the retaining element has an opening, and a lock cylinder can be accommodated in the opening.

3. A handle according to claim 2, wherein the attachment segment is oriented at an angle $\alpha$ to the second side of the retaining element situated on the outer paneling, and the angle $\alpha$ is within a range of approximately $0 \leq \alpha \leq 75°$.

4. A handle according to claim 2, wherein the retaining element has at least one attachment means, and a protective cap is attached to said attachment means, wherein the protective cap covers the opening and/or the lock cylinder.

5. A handle according to claim 4, wherein the protective cap can be attached on the retaining element and can be removed from the same.

6. A handle according to claim 4, wherein the protective cap has a locking connection to the retaining element.

7. A handle according to claim 6, wherein the protective cap has at least one window, wherein an auxiliary device can be manually inserted through the window in order to release the locking connection.

8. A handle according to claim 4, wherein the retaining element has at least one bearing surface, wherein the protective cap abuts this bearing surface.

9. A handle according to claim 8, wherein the protective cap is a 2-piece component, wherein a first element is an outer body, and a second element of the protective cap is the locking elements.

10. A handle according to claim 2, wherein the locking cylinder and/or a dummy is situated in the opening, wherein the locking cylinder and/or the dummy is positioned in the region of a opening flush with the retaining element.

11. A handle according to claim 2, wherein the lock cylinder is designed with a housing, wherein the housing is designed in such a manner that the housing is attached to the first arm by means of the attachment means.

12. A handle according to claim 11, wherein the housing has a collar molded onto the housing which protects the attachment means.

13. A handle according to claim 1, wherein the retaining element is constructed from a metallic material comprising a steel, wherein a thickness S of the retaining element is in the range of approximately $0.5\ mm \leq S \leq 3\ mm$.

* * * * *